US011492175B2

(12) United States Patent
Wang et al.

(10) Patent No.: US 11,492,175 B2
(45) Date of Patent: Nov. 8, 2022

(54) WATER CONTAINER SLEEVE WITH STORAGE POCKETS

(71) Applicants: Kunyi Wang, Maple (CA); Michael Tze-ming Chiu, Maple (CA)

(72) Inventors: Kunyi Wang, Maple (CA); Michael Tze-ming Chiu, Maple (CA)

(73) Assignee: BLAKESTONE US LLC, Wilmington, DE (US)

( * ) Notice: Subject to any disclaimer, the term of this patent is extended or adjusted under 35 U.S.C. 154(b) by 283 days.

(21) Appl. No.: 16/773,987

(22) Filed: Jan. 28, 2020

(65) Prior Publication Data

US 2021/0229865 A1 Jul. 29, 2021

(51) Int. Cl.

| | |
|---|---|
| ***B65D 23/12*** | (2006.01) |
| ***A45F 3/18*** | (2006.01) |
| ***B65D 23/08*** | (2006.01) |

(52) U.S. Cl.

CPC ..... *B65D 23/12* (2013.01); *A45F 3/18* (2013.01); *B65D 23/0871* (2013.01)

(58) Field of Classification Search

CPC ..... A45F 2200/0583; A45F 2200/0558; A45F 2200/055; A45F 2200/0516; B65D 23/12; B65D 23/0871

USPC ..... 215/390

See application file for complete search history.

(56) References Cited

U.S. PATENT DOCUMENTS

| | | | | |
|---|---|---|---|---|
| 2,464,069 | A * | 3/1949 | Benson | B65D 23/104 206/466 |
| 6,062,434 | A * | 5/2000 | Melk | A45F 3/16 222/175 |
| 6,073,796 | A * | 6/2000 | Mogil | A45F 3/16 215/12.1 |
| 6,276,579 | B1 * | 8/2001 | DeLoach | A45F 3/16 220/592.24 |
| 6,401,993 | B1 * | 6/2002 | Andrino | A45F 5/00 224/148.5 |
| 7,252,213 | B1 * | 8/2007 | DeSanto | A45F 5/00 224/148.4 |
| D601,794 | S * | 10/2009 | Jarvio | D3/229 |
| 8,820,367 | B2 * | 9/2014 | Reyes | A45F 3/02 150/106 |
| 9,265,318 | B1 * | 2/2016 | Williams | A45F 3/06 |
| D773,809 | S * | 12/2016 | Lieser | D3/232 |
| 9,861,171 | B1 * | 1/2018 | Burnside | A45C 11/00 |
| D923,427 | S * | 6/2021 | Malinky | D7/624.2 |
| 2010/0102096 | A1 * | 4/2010 | Willows | A45F 5/00 224/148.1 |
| 2013/0334237 | A1 * | 12/2013 | Priest | B67B 7/40 220/739 |
| 2015/0021346 | A1 * | 1/2015 | Cappuccio | A45F 5/00 220/735 |
| 2015/0265083 | A1 * | 9/2015 | Myers | A45F 5/10 220/739 |

(Continued)

*Primary Examiner* — Ernesto A Grano

(74) *Attorney, Agent, or Firm* — Loza & Loza, LLP; Heidi Eisenhut

(57) ABSTRACT

The proposed invention is a water container sleeve with built in pockets. The sleeve is made out of neoprene or other compatible material, features pockets on multiple sides and a band that allows a cellphone to slip between it and be held. The sleeve not only gives the water bottle additional functionality, but protects the bottle from outside environment and offers customization.

11 Claims, 4 Drawing Sheets

(56) References Cited

U.S. PATENT DOCUMENTS

| | | | | |
|---|---|---|---|---|
| 2016/0198877 | A1* | 7/2016 | Ni | B65D 23/12 455/575.1 |
| 2017/0225833 | A1* | 8/2017 | Ni | H02J 7/0021 |
| 2018/0153326 | A1* | 6/2018 | Parinella | A45C 11/321 |
| 2020/0085177 | A1* | 3/2020 | Walk | A45C 13/30 |
| 2020/0237082 | A1* | 7/2020 | Willows | A45C 3/00 |
| 2020/0339305 | A1* | 10/2020 | Pearce | A45F 3/18 |
| 2021/0130040 | A1* | 5/2021 | Sanders | B65D 23/0842 |
| 2021/0137248 | A1* | 5/2021 | Dow | A45F 3/02 |
| 2021/0244219 | A1* | 8/2021 | Richard | A45F 5/021 |

* cited by examiner

WATER CONTAINER SLEEVE WITH STORAGE POCKETS

CROSS REFERENCE TO RELATED APPLICATIONS

Statement Regarding Federally Sponsored Research or Development

Not Applicable

NAMES OF PARTIES TO A JOINT RESEARCH AGREEMENT

Not Applicable

INCORPORATION BY REFERENCE OF ELECTRONIC MEDIA

Not Applicable

STATEMENT REGARDING PRIOR DISCLOSURES

Not Applicable

FIELD OF THE INVENTION

The present invention generally relates to water carrying containers. More specifically, a sleeve that goes around a standard water bottle and adds functionality via pockets, bands and use.

BACKGROUND OF THE INVENTION

We compete in the water bottle industry, specifically, in the water jug section of the industry which hold 1.5-2.5 liters. The jug section is a less competitive relative to the entire bottle industry, which is getting saturated. Even though there have been many new entrants over the past few years, demand only takes off for products that are sufficiently differentiated, solve user problems and deploy the right marketing tactics in terms of page ranking, social media etc.

The industry has 4 consumer demand areas that are solved by our product,

1. Water bottles are increasingly viewed as a fashion accessory, especially for the "young, hip and active". Our sleeves come in tasteful designs which cater to this demographic.

2. Many water bottles on the market face complaints, such as breaking easily after falling. our sleeve helps to protect the jug and maintain water temperature.

3. When a customer is on the move, it's often cumbersome to take smartphone, wallet and water jug separately. Furthermore, many gyms ask customers to leave their bags and accessories in lockers (and most offer no locks). Our sleeve is designed to store a phone, cards and keys without interfering with exterior aesthetics. Phone storage is also designed so the user can access it easily, without having to unzip or open pouches.

4. Being able to see into the container and/or determine how much is in the container is important for some consumers—our sleeve has opposing windows that solve this problem.

Our product's main differentiation lies in its ability to marry aesthetics with functionality, beautifully meeting the aforementioned 4 key emerging trends in a simplistic way. There are other jug products with aesthetically pleasing sleeves, but are not functional, for example, no windows for water levels, no storage for accessories and phones. while other competitors have functional sleeves that are far from being "fashion statements".

A BRIEF DESCRIPTION OF CURRENT INVENTION

The proposed invention is a water container sleeve with built in pockets. The sleeve is made out of neoprene or other compatible material, features pockets on multiple sides and a band that allows a cellphone to slip between it and be held. The sleeve not only gives the water bottle additional functionality, but protects the bottle from outside environment and offers customization.

REFERENCE NUMERALS IN DRAWINGS

Figure 3:
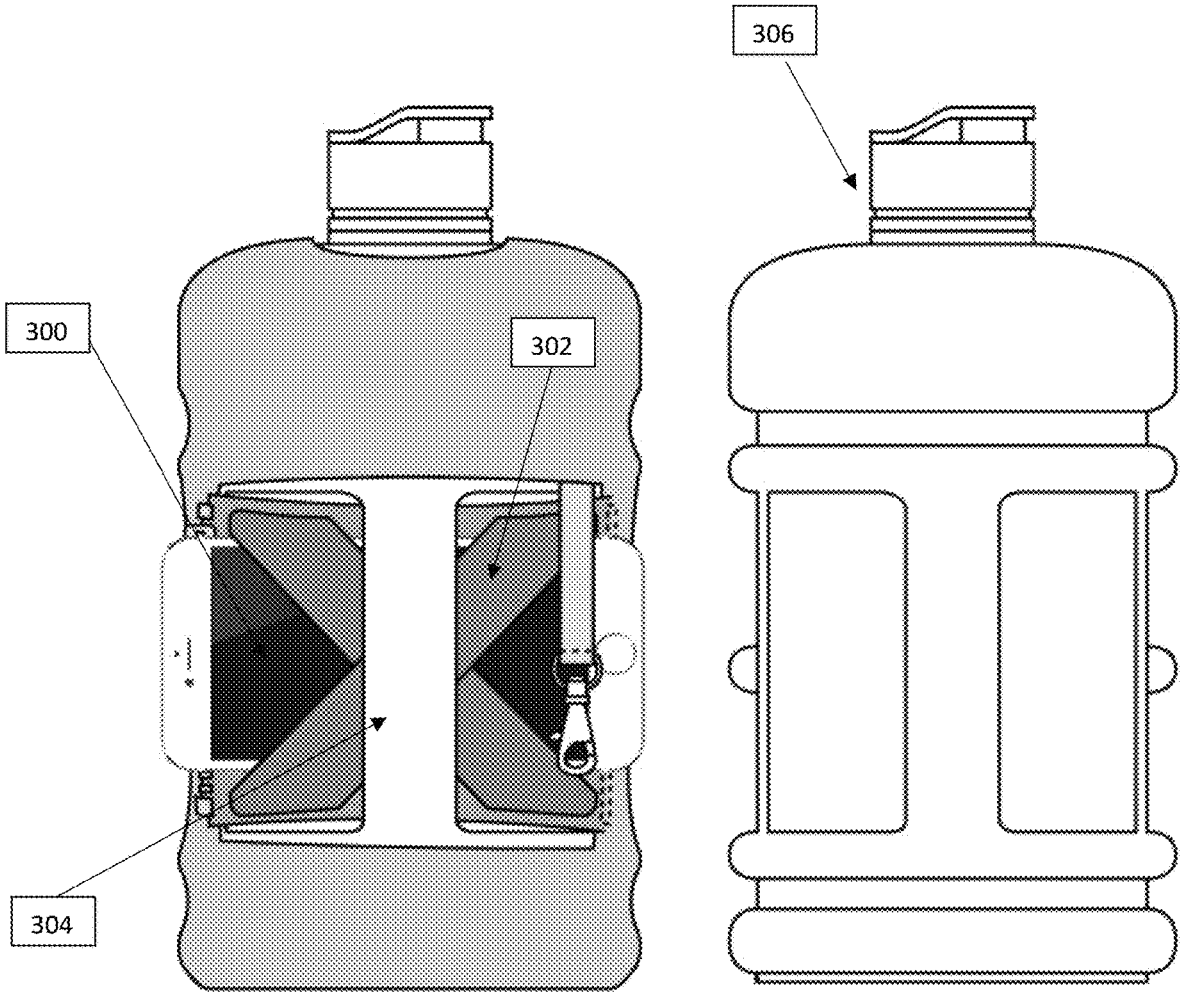
FIG. 3 is an illustrative representation showing a line drawn depiction of the water bottle sleeve with a sleeveless water bottle for comparison viewed from the front side with a cellphone in accordance with an embodiment of the present invention.
Figure 4:
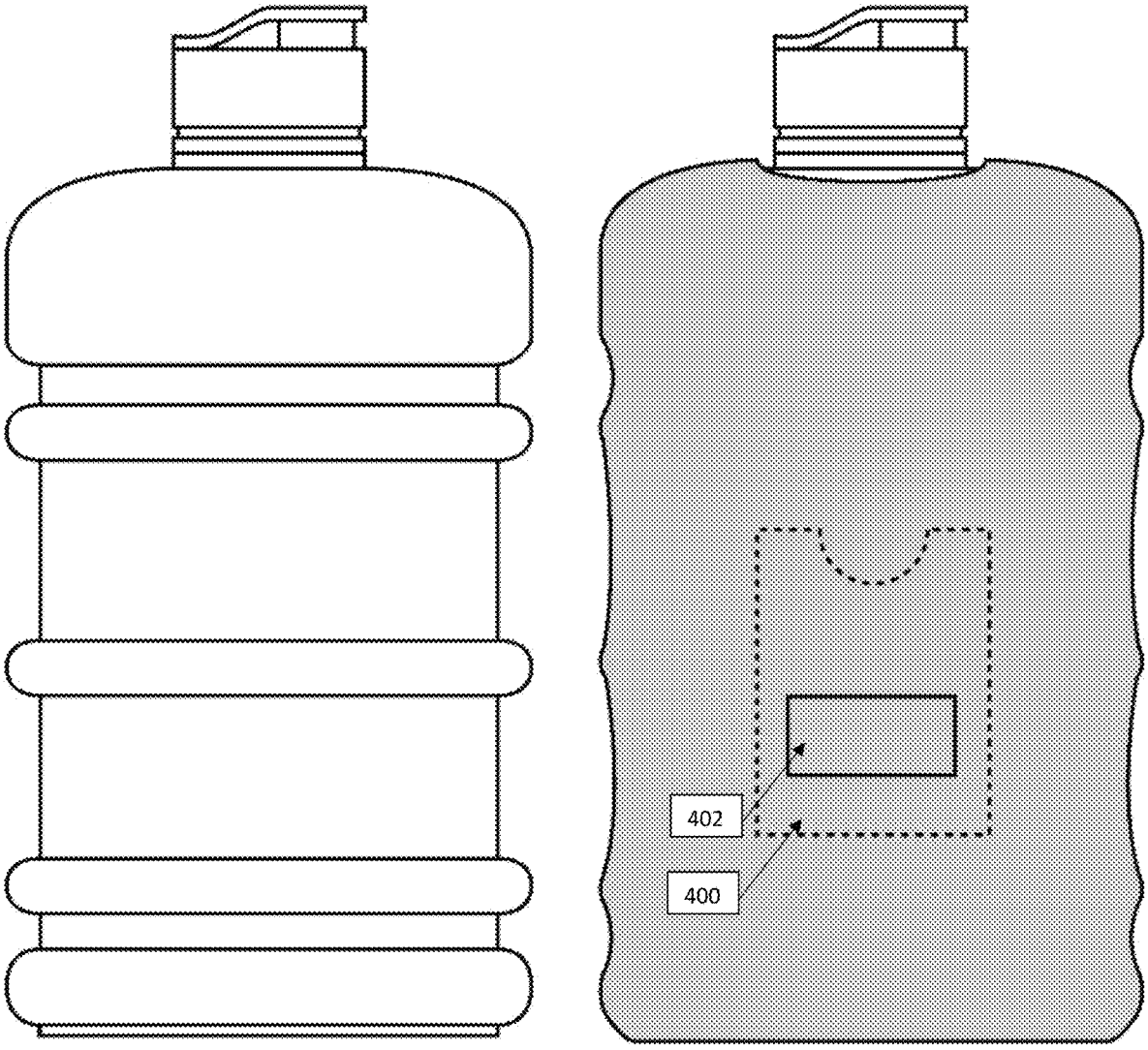
FIG. 4 is an illustrative representation showing a line drawn depiction of the water bottle sleeve with a sleeveless water bottle for comparison viewed from the back side in accordance with an embodiment of the present invention.

100 Sleeve (FIG. 1)
102 Water Gauge (FIG. 1)
104 Connection on Pocket (FIG. 1)
106 Handle of Container (FIG. 1)
108 Connection (FIG. 1)
110 Zipper up (FIG. 1)
112 Shoulder Strap (FIG. 1)
114 Loop Ring (FIG. 1)
116 Card Slot (FIG. 1)
200 Zipper up (FIG. 2)
202 Cover/Pocket (FIG. 2)
204 Zipper (FIG. 2)
206 Band (FIG. 2)
208 Connection (FIG. 2)
210 Cover (FIG. 2)
212 Water Bottle (FIG. 2)
214 Water Bottle Handle (FIG. 2)
300 Cell Phone (FIG. 3)
302 Stretchy Band (FIG. 3)
304 Handle on Bottle (FIG. 3)
306 Sleeve (FIG. 3)
400 Slot (FIG. 4)
402 Logo on Slot (FIG. 4)

DETAILED DESCRIPTION

Figure 1:
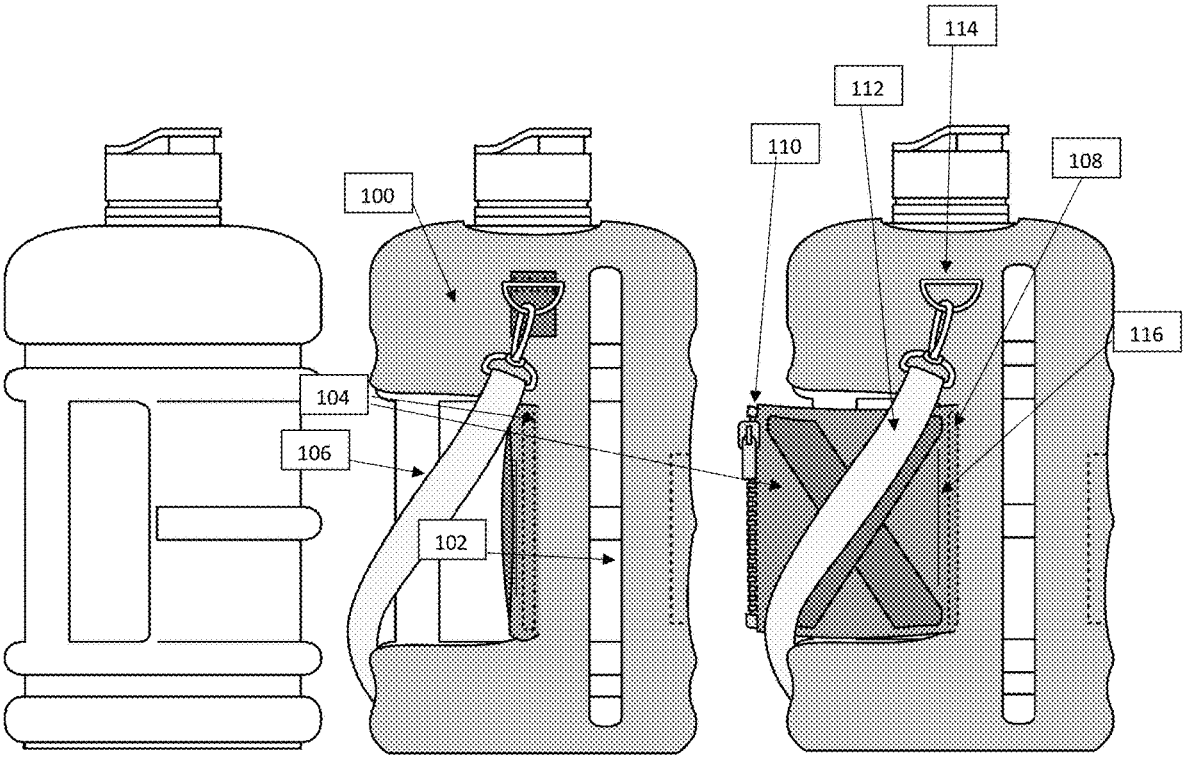
FIG. 1 is an illustrative representation showing a line drawn depiction of the water bottle sleeve with a sleeveless water bottle for comparison viewed from the right side in accordance with an embodiment of the present invention.

FIG. 1 is an illustrative representation showing a line drawn depiction of the water bottle sleeve with a sleeveless water bottle for comparison viewed from the right side in accordance with an embodiment of the present invention. This depiction provides the reader of this document with a side of a water bottle without a sleeve on it. There is also a depiction of the water bottle with the sleeve on with the door open/closed. The sleeve (100) material is made out of neoprene or other material. The sleeve may feature a cut out for a water gauge (102) section if desired. The water gauge section is optional and may be covered. The sleeving fits tightly around the water bottle adding protection. The sleeving features a connected cover (104) near/beneath the handle (106) of the water bottle. The cover is connected (108) to the sleeving on one end and uses a zipper (110) to close on the other end. Basically creating an opening storage that opens and closes. The door is made out of the same material the sleeving is, which is able to contour and move freely when unzipped. Similar to rubber or cloth. The door functions by using its zipper to stay closed or be opened up. (108) depicts the attachment of the cover to the sleeving. The cover is part of the sleeving and the depiction shows the joint points. The inner surface of the door may also feature a spandex/rubberized slot, similar to the one in FIG. 4 (400) to insert objects such as cards or money. The invention may also feature a shoulder strap (112), which may be connected to the loop rings (114). An additional card slot (116) is located on the door of the cover.

Figure 2:
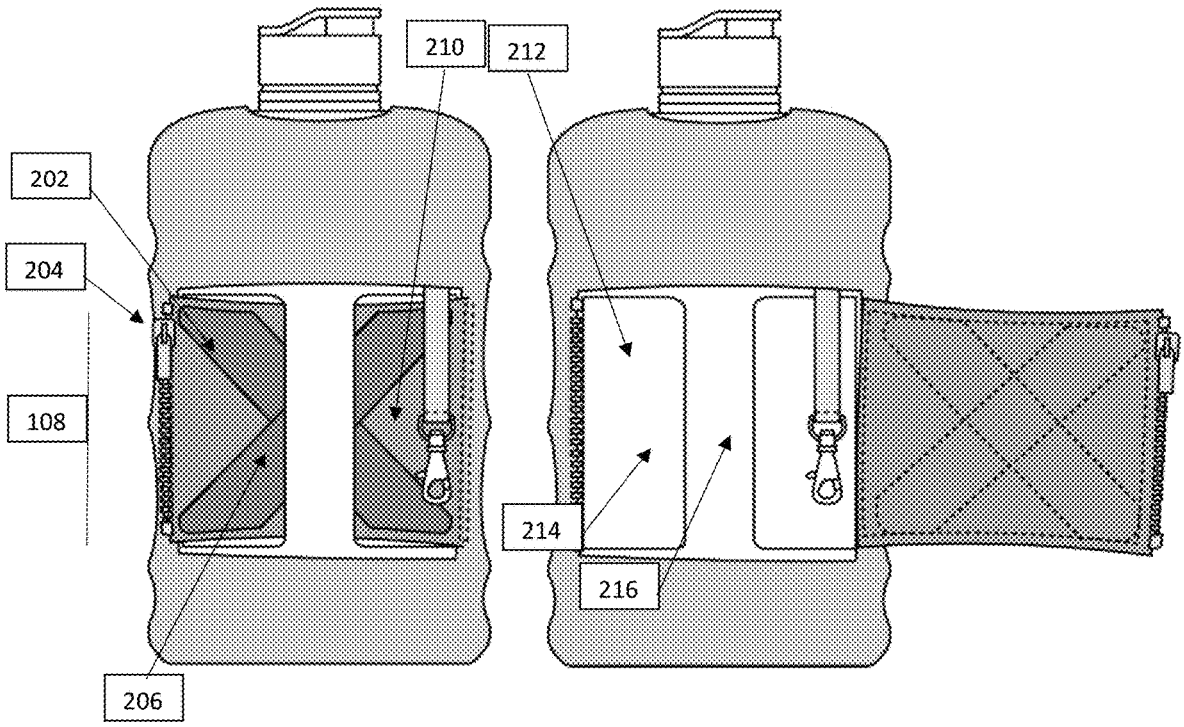
FIG. 2 is an illustrative representation showing a line drawn depiction of the water bottle sleeve viewed from the front side in accordance with an embodiment of the present invention.

FIG. 2 is an illustrative representation showing a line drawn depiction of the water bottle sleeve viewed from the front side in accordance with an embodiment of the present invention. This depiction provides the view of the front of the water bottle with sleeve illustration. Here, the sleeves pocket is seen zipped up (200) and closed to hold the cover (202). The cover may be attached in different methods and does not specifically require to have a zipper (204) and can use other means of fastening. The band feature (206) on the pocket is seen attached such as, sewn (208) on, straight onto the outer surface of the cover (210). The band is in the shape of an X and allows a phone to be inserted. The band allows a user to slide their cellphone though when not in use. FIG. 3 depicts this better. When the pocket is opened, it reveals the see-through water bottle (212). The sleeve may also have the section covered if necessary in manufacturing. The cover is soft and is able to bend in order to travel underneath the water bottle handle (214) to close. (210) depicts the attachment of the cover to the sleeving. The cover is part of the sleeving and the depiction shows the joint points.

FIG. 3 is an illustrative representation showing a line drawn depiction of the water bottle sleeve with a sleeveless water bottle for comparison viewed from the front side with a cellphone in accordance with an embodiment of the present invention. This depiction provides the reader with a depiction of use. The cellphone (300) is seen inserted into the stretchy X band (302) attached to the cover. It is fit snug with the additional support of the water bottle handle (304) which provides a good location for a cell phone to sit. If the water bottle did not have the sleeve on it (306), the phone would not have the ability to sit in the crevice. This is due to the lack of cover and support provided on the sleeve. As seen, the phone is being pressed into the crevice in the bottle with the band attached to the overall sleeve.

FIG. 4 is an illustrative representation showing a line drawn depiction of the water bottle sleeve with a sleeveless water bottle for comparison viewed from the back side in accordance with an embodiment of the present invention. This depiction provides an additional angle and additional feature on this invention. The back of the sleeve will feature a spandex/rubberized slot (400) to insert objects such as cards or money. The logo (402) of the company will be printed on the pocket.

Note

108 and 210 depict the attachment of the cover to the sleeving. The cover may be sewn on or be part of the sleeving.

Embodiments include a water bottle sleeve with features. These features included, but not limited to, pockets, bands, pictures, etc.

The invention claimed is:

1. A water container and sleeve, comprising:

a main body defined by a sidewall secured between a bottom wall and a top wall, the top wall having a top opening for receiving a water container;

a sleeve pocket located in the sidewall, the sleeve pocket defined by a flap moveable between an open configuration and a closed configuration;

a first elastic band coupled to a first upper corner of the flap and a second lower corner of the flap, where the first upper corner is diagonally opposed to the second lower corner;

a second elastic band coupled to a second upper corner of the flap and a first lower corner of the flap, where the second upper corner is diagonally opposed to the first lower corner;

wherein a handle of the water container extends through the sleeve pocket when the flap is in the open configuration; and wherein the flap is secured behind the handle of the water container when in the closed configuration.

2. The water container and sleeve of claim 1, wherein the flap comprises:

an outer surface and an opposing outer surface; and a perimeter formed by an upper edge, a lower edge, a first side edge, and a second side edge by a first side edge and a second side edge;

wherein the second side edge is integrally connected to the sidewall of the main body; and wherein the first side edge includes a first zipper edge detachably connected to a second zipper edge in the sidewall of the main body.

3. The water container and sleeve of claim 1, wherein the main body is made of neoprene.

4. The water container and sleeve of claim 1, wherein the first and second elastic bands secure an object behind the handle of the water container.

5. The water container and sleeve of claim 4, wherein the object is a cell phone.

6. The water container and sleeve of claim 1, further comprising an elongated water gauge opening extending vertically along the sidewall of the main body.

7. A water container and sleeve, comprising:

a main body defined by a sidewall secured between a bottom wall and a top wall, the top wall having a top opening for receiving a water container;

a sleeve pocket located in the sidewall, the sleeve pocket defined by a flap moveable between an open configuration and a closed configuration, the flap comprises:

an outer surface and an opposing outer surface;

a perimeter formed by an upper edge, a lower edge, a first side edge, and a second side edge by a first side edge and a second side edge;

wherein the second side edge is integrally connected to the sidewall of the main body; and wherein the first side edge includes a first zipper edge detachably connected to a second zipper edge in the sidewall of the main body; and a first elastic band coupled to a first upper corner of the flap and a second lower corner of the flap, where the first upper corner is diagonally opposed to the second lower corner;

a second elastic band coupled to a second upper corner of the flap and a first lower corner of the flap, where the second upper corner is diagonally opposed to the first lower corner;

wherein a handle of the water container extends through the sleeve pocket when the flap is in the open configuration; and wherein the flap is secured behind the handle of the water container when in the closed configuration.

8. The water container and sleeve of claim 7, wherein the main body is made of neoprene.

9. The water container and sleeve of claim 7, wherein the first and second elastic bands secure an object behind the handle of the water container.

10. The water container and sleeve of claim 9, wherein the object is a cell phone.

11. The water container and sleeve of claim 7, further comprising an elongated water gauge opening extending vertically along the sidewall of the main body.

* * * * *